United States Patent [19]

De La Taille et al.

[11] 3,995,893

[45] Dec. 7, 1976

[54] CUSHION COMPRISING A SQUAB INCLUDING AT LEAST TWO PARTS CONNECTED BACK TO BACK

[75] Inventors: Olivier P. De La Taille; Jean Francois Labadie; Armand R. Bernard, all of Etampes, France

[73] Assignee: Etablissements Bertrand Faure, Le Chesnay, France

[22] Filed: June 10, 1975

[21] Appl. No.: 585,599

[30] Foreign Application Priority Data

June 14, 1974 France ..... 74.20793

[52] U.S. Cl. ..... 297/452; 5/353.2

[51] Int. Cl.[2] ..... A47C 5/06

[58] Field of Search ..... 297/452, 220, 444, 443, 297/391; 5/353.3, 353.2, 353.1

[56] References Cited

UNITED STATES PATENTS

| | | | |
|---|---|---|---|
| 2,151,628 | 3/1939 | Van Derveer | 297/452 |
| 2,853,125 | 9/1958 | Starke | 297/444 |
| 3,557,264 | 1/1971 | Getz et al. | 297/452 |
| 3,642,322 | 2/1972 | Bilancia | 297/444 |
| 3,800,343 | 4/1974 | Fruchte | 297/452 |
| 3,833,260 | 9/1974 | Harder, Jr. | 297/452 |

FOREIGN PATENTS OR APPLICATIONS

| | | | |
|---|---|---|---|
| 1,228,074 | 4/1960 | France | 5/353.2 |

*Primary Examiner*—Ramon S. Britts
*Assistant Examiner*—Darrell Marquette
*Attorney, Agent, or Firm*—Oblon, Fisher, Spivak, McClelland & Maier

[57] ABSTRACT

A cushion includes a squab which is formed from first and second cooperating body parts mated together by a peripheral rim and recess respectively formed in the body parts. A cavity is formed internally of the body parts and a frame member is disposed therein. A channel is also formed within the peripheral rim of the first body part and a resilient wire is disposed therein for holding therein the periphery of a cover of the second part whereby the two parts are held together.

2 Claims, 2 Drawing Figures

CUSHION COMPRISING A SQUAB INCLUDING AT LEAST TWO PARTS CONNECTED BACK TO BACK

The present invention relates to a cushion comprising a squab including at least two parts each having a face and a back in which said two parts are connected back-to-back, are each enclosed in a cover, and together define a cavity for receiving a supporting frame.

It is to be understood that the word "cushion" as used herein is used in a very general sense and designates any upholstered article adapted to be used for domestic purposes. The word therefore encompasses not only a cushion as such but also, for example, a seat, an item of furniture, or a component of a bed, settee or the like.

The component parts of the squab of a known cushion of the above-mentioned type are usually joined together by bonding whereas their covers are connected by fasteners or by stitching.

Unfortunately, these various operations are lengthy and often difficult. Furthermore, skilled and therefore expensive labour is required for carrying them out.

It is an object of the present invention to overcome these difficulties.

Accordingly the present invention provides a cushion comprising a squab including at least two cooperating body parts each having a face and a back, wherein the two body parts are connected back-to-back and together define a cavity for receiving a supporting frame, one of said two body parts of the squab is made of a semi-rigid material, is provided with a cover on its face, and has a rim portion extending around the periphery of the frame, and said rim portion is provided with an outer peripheral channel disposed substantially in the plane of the frame and adapted to receive a resilient wire for holding in the channel the periphery of a cover covering the face of the second body part of the squab and thereby holding the two parts of the squab firmly against each other.

By means of this arrangement, the two body parts of the squab can be held together and their covers can be joined more easily and more rapidly than hitherto since bonding operations on the one hand and fastening or stitching operations on the other are no longer required. Consequently, considerably less skilled labour is required for the work and the rate of production can be increased.

It will thus be readily appreciated that the cost of producing the cushions may be appreciably lower than that of producing the known cushions.

Advantageously, the rim extending around the frame is seated in a recess formed in the other part of the squab.

Thus, the two parts of the squab cannot readily be displaced relatively to each other, and they are consequently held firmly together.

In the particular case where the cushion forms the back rest of a vehicle seat, the frame of which comprises a U-shaped tube, opposite ends of the resilient wire, which is likewise U-shaped, are secured to the ends of the limbs of the frame tube.

After its ends have been secured, the resilient wire thus cannot accidentally move out of the channel.

A preferred embodiment of the present invention is illustrated by way of example in the accompanying drawings, in which.

Figure 1:
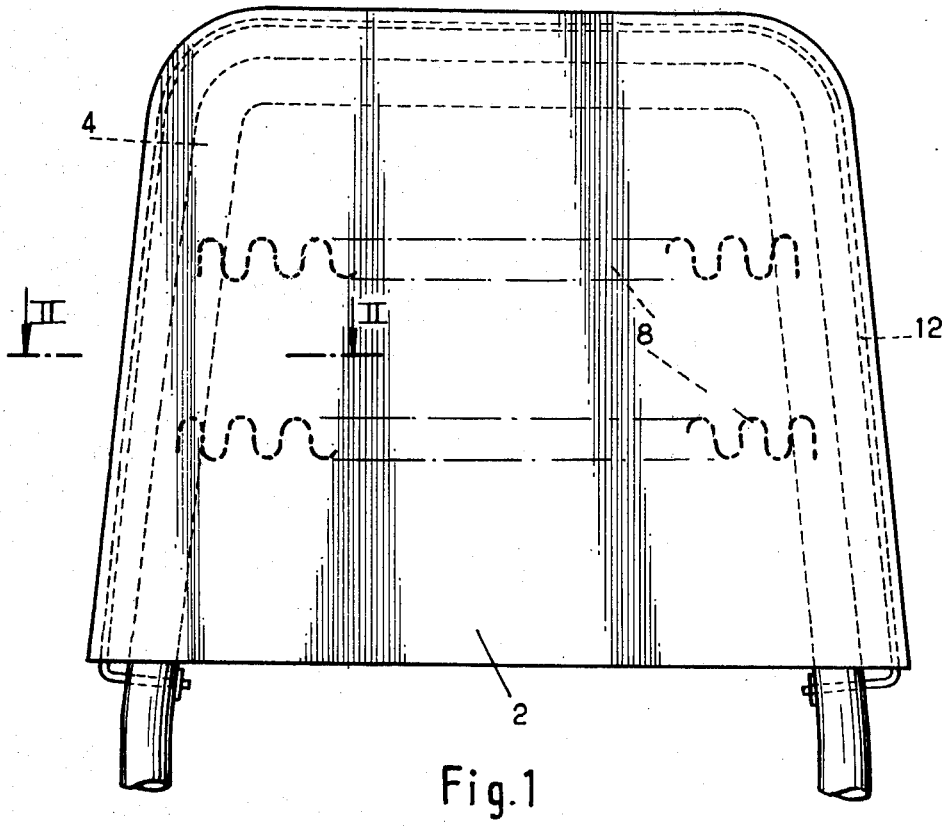
FIG. 1 is a diagrammatic front view of a backrest of a seat.
Figure 2:
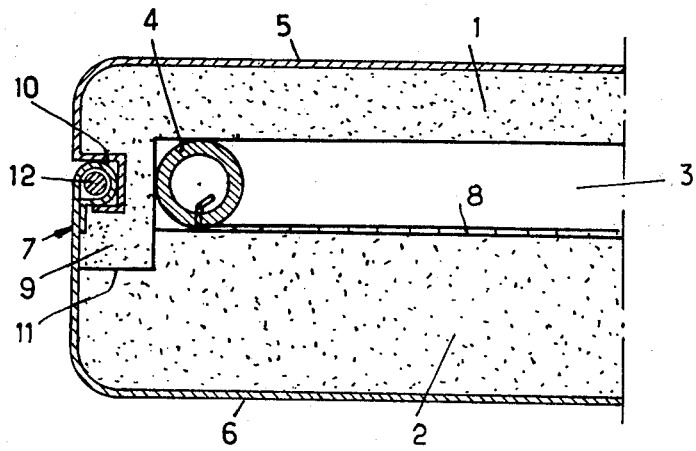
FIG. 2 shows, on a larger scale than FIG. 1, a section along line II—II of FIG. 1.

The seat back-rest seen in the drawings consists mainly of a squab comprising two body parts 1 and 2 which are connected back-to-back and form a cavity 3 enclosing a tubular metal frame 4. The part 1 of the squab, which forms a rear face of the back-rest, is of a semi-rigid material. The part 2, however, which forms a front face of the back rest is made of a foamed material which is sufficiently supple to adapt itself to the configuration of the back of a user of the seat and to provide him with some degree of comfort. Also, to give the back-rest a pleasing appearance, the parts 1 and 2 of the squab are enclosed in covers 5 and 6 respectively, the cover 5 lying against the part 1 over its entire surface, whereas the cover 6 lies against the part 2 but does not cover a peripheral edge portion 7.

The frame 4 is formed in a conventional manner of a U-shaped tube, and springs 8 (of a flat corrugated kind) are attached to the limbs of the U for supporting the foamed material of which the part 2 is made and for preventing the material from penetrating into the interior of the cavity 3.

The part 1 of the squab has a rim 9 which extends around the frame on the upper edge of the frame and at the side edges of the back-rest. This rim, which is provided with an outwardly facing peripheral channel 10 located substantially in the plane of the frame, is advantageously seated in a complementary recess 11 cut in the part 2 of the squab. Thus, when the parts 1 and 2 are brought together, they cannot readily be displaced relatively to each other, and this avoids the possibility of the back-rest becoming deformed.

The channel 10 accommodates a wire 12, and the ends of the wire 12 are secured by, for example, "TRUARC" rings to the ends of the limbs of the frame tube. The wire 12 is resilient and is used to hold the periphery of the cover 6 in the channel 10. When retained in this way, the cover 6 ensures that the parts 1 and 2 are held firmly against each other.

To produce a seat back-rest such as that illustrated in the drawings, the frame 4 is placed between the two parts 1 and 2 forming the squab, and these two parts are brought together in such a way that the rim 9 of the part 1 is seated in the recess 11 cut in the part 2.

A hem in which the wire 12 is threaded is then formed at the periphery 7 of the cover 6, and the wire is then snapped into the channel, making use of the resilience of the wire.

The periphery of the cover 6 is then retained in the channel 10 in a perfect manner, and this ensures that the two parts constituting the squab are held firmly together.

To prevent the wire 12 from being accidentally moved out of the channel 19, the ends of the wire are secured to the ends of the limbs of the frame tube as illustrated in FIG. 1.

To ensure that the periphery of the cover 6 is retained correctly in the straight portions of the channel 10, the wire 12 may advantageously include portions that are not rectilinear but which are bowed inwards towards the interior of the cavity 3, so that along the straight portions of the channel these bowed portions of the wire apply a greater pressure on the floor of the channel and therefore stretch the cover in a uniform manner.

It will therefore be seen that the joining of the two parts forming the squab and the connection of their covers are achieved in a simple manner.

What we claim is:

1. A cushion comprising:

a squab including at least two cooperating body parts each having a face and a back, wherein the two body parts are connected back-to-back and together define therebetween a cavity, a first one of said two body parts of the squab is made of a semi-rigid material, is provided with a cover on its face, and has a rim portion extending around the periphery thereof, while the second one of said two body parts of said squab is made of a resilient material, is provided with a cover on its face, and has a recess portion extending around the periphery thereof within which said peripheral rim of said first squab part is seated, a supporting frame disposed within said cavity and surrounded by said assembled body parts, said rim portion is provided with an outer peripheral channel disposed substantially in the plane of the frame, and a resilient wire disposed in said channel for holding in said channel the periphery of said cover covering the face of the second body part of the squab and thereby holding the two parts of the squab firmly against each other.

2. A cushion as claimed in claim 1 wherein said cushion is the back-rest of a vehicle seat, the frame of which seat consists of a U-shaped tube wherein opposite ends of the resilient wire, which is likewise U-shaped, are secured to the ends of the limbs of the frame tube.

* * * * *